United States Patent [19]

Coon

[11] Patent Number: 4,871,326

[45] Date of Patent: Oct. 3, 1989

[54] ELECTRICAL HARNESS HAVING ONE CONNECTOR INTENDED FOR CIRCUIT BOARD MOUNTING

[75] Inventor: Paul A. Coon, Harrisburg, Pa.

[73] Assignee: AMP Incorporated, Harrisburg, Pa.

[21] Appl. No.: 233,195

[22] Filed: Aug. 17, 1988

[51] Int. Cl.[4] ..... H01R 9/09

[52] U.S. Cl. ..... 439/502; 29/840

[58] Field of Search ..... 439/55, 67, 77, 78, 439/81, 82, 83, 502, 505, 894; 29/832, 840, 857, 865, 866

[56] References Cited

U.S. PATENT DOCUMENTS

| | | | |
|---|---|---|---|
| 3,958,853 | 5/1976 | Wilson | 439/398 |
| 4,087,146 | 5/1978 | Hudson Jr. | 439/67 |
| 4,093,334 | 6/1978 | Wickenberg et al. | 439/459 |
| 4,601,530 | 7/1986 | Coldran et al. | 439/460 |
| 4,719,321 | 1/1988 | Kozal et al. | 174/135 |
| 4,797,112 | 1/1989 | Weisenburger | 439/65 |

*Primary Examiner*—Neil Abrams

*Attorney, Agent, or Firm*—Robert W. Pitts

[57] ABSTRACT

Electrical harness for connecting circuit board conductors to conductors external to the circuit board comprises first and second housings which are disengageably secured to each other. Conductors extend as a loop from the first housing to terminals in the second housing. The first housing has terminals which can be soldered to the circuit board conductors and the circuit board can, after installation of the first housing therein, be installed in the apparatus for which it is intended. Thereafter, the second housing is disengaged from the first housing and installed at its location in the apparatus.

20 Claims, 7 Drawing Sheets

ELECTRICAL HARNESS HAVING ONE CONNECTOR INTENDED FOR CIRCUIT BOARD MOUNTING

FIELD OF THE INVENTION

This invention relates to electrical harnesses for connecting circuit board conductors on a circuit board to external conductors, to the connector housings for such harnesses, and to the method of manufacturing such harnesses and installing them on the circuit board.

BACKGROUND OF THE INVENTION

In the manufacture and assembly of machines or apparatus having a circuit board therein, it is frequently necessary to connect circuit board conductors on the circuit board to further conductors or external conductors which are remote from the circuit board. If the circuit board conductors have their terminal pad portions spaced from the edge of the circuit board (thereby precluding the use of an edge connector) the connections to the circuit board conductors are made by mounting a connecting device on the circuit board, soldering terminals in the connecting device to the circuit board conductors, and then using an electrical harness having one connector thereon which can be coupled to the circuit board connector and another connector which can be coupled to the external conductors. The circuit board connector may be of the surface mount type, which can be used where the circuit board conductors are on the same surface of the circuit board as the surface on which the connector is mounted, or may be a pinheader, (the type having contact pins which extend through holes in the circuit board and which can be soldered to the conductors on the underside of the circuit board).

Three connectors are thus required for the prior art method of making connections to circuit boards as described above. The instant invention is directed to the achievement of electrical harnesses and to the achievement of manufacturing and assembling methods which will reduce the number of connectors required and thereby reduce the costs of connecting external conductors to circuit board conductors in a manufacturing process.

THE INVENTION

In accordance with one aspect thereof, the invention comprises an electrical harness which is destined for installation in an apparatus which has a circuit board therein, the circuit board having circuit board conductors thereon. The harness comprises first and second electrical connector housings having first and second terminal means therein and flexible conductors which extend between the first and second terminal means. The first housing is destined for installation in the apparatus at a first location which is on the circuit board and the second housing is destined for installation in the apparatus at a second location which is not on the circuit board. The harness is characterized in that the first and second housings are adjacent to each other and are disengageably secured to each other with the flexible conductors forming a loop which extends from the first housing to the second housing. The first terminal means have surface portions for soldering to circuit board conductors so that the first housing can be mounted on the circuit board and the first terminal means soldered to the circuit board conductors while the first and second housings are secured to each other. Thereafter, the circuit board can be installed in the apparatus, the second housing can be disengaged from the first housing, and the second housing can be installed in the apparatus at the second location.

In one embodiment, the flexible conductors are discrete wires and each of the first and second housings has a wire-receiving surface, an obverse surface which faces oppositely with respect to the wire-receiving surface, first and second side surfaces which extend from the wire-receiving surface to the obverse surface, and oppositely facing end wall surfaces. Each of the housings has a plurality of side-by-side wire-receiving cavities extending into its wire-receiving surface, the cavities being in a row and extending transversely of the side surfaces. Each of the wire-receiving cavities has wire retaining means therein, the first and second housings being in side-by-side relationship with their first side surfaces mutually opposed to each other. Advantageously, the first housing which is intended for mounting on the circuit board, has mounting means on the second side surface thereof so that it can be mechanically secured to the circuit board while soldering is carried out.

In accordance with the method aspect of the invention, the first and second connectors required for the harness are provided as a unit with the connectors disengageably joined to each other. The flexible conductors are assembled to the first and second connectors so that the intermediate portions of the conductors extend between the connectors as a loop. The first connector is installed on the circuit board and the terminal means in the first connector are soldered to the circuit board conductors. The circuit board can then be installed in the apparatus, the second connector can be disengaged from the first connector and the second connector installed in the apparatus at a remote location.

THE DRAWING FIGURES

THE DISCLOSED EMBODIMENT

Figure 1:
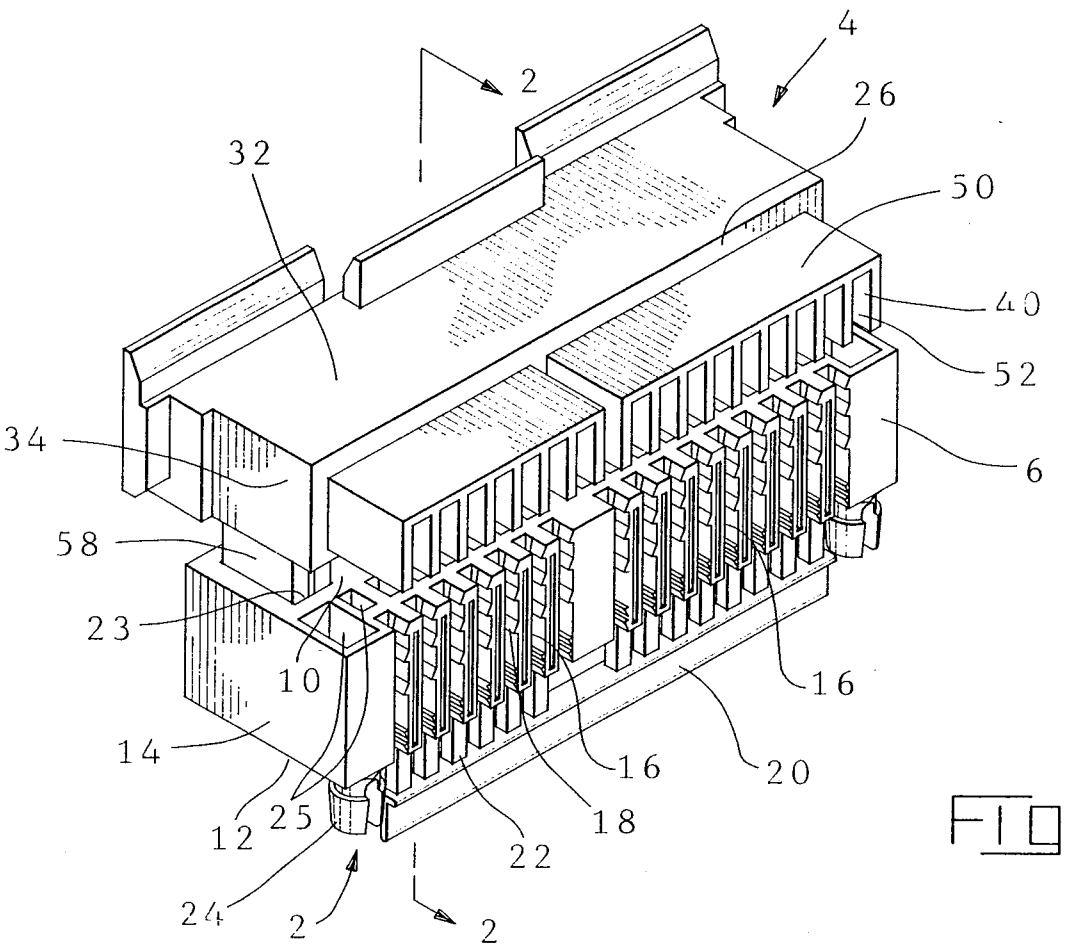
FIG. 1 is a perspective view of a pair of connector housings in accordance with the invention which are disengageably secured to each other, this view showing the wire-receiving surfaces of the housings.
Figure 2:
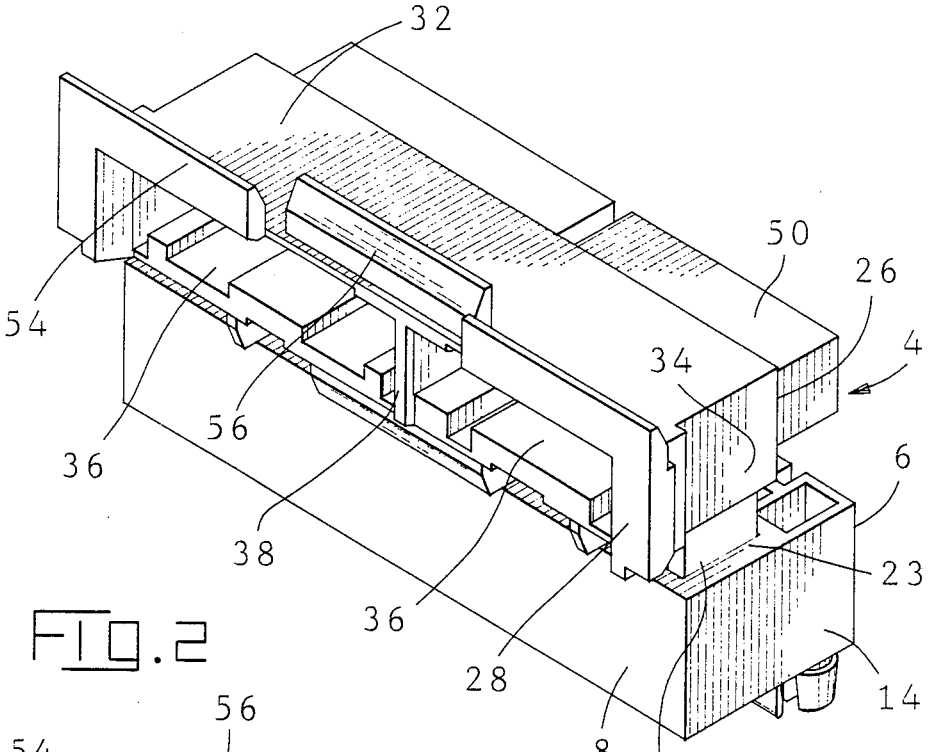
FIG. 2 is a view looking in the direction of the arrows 2—2 of FIG. 1 showing the obverse surfaces.

FIGS. 1–4 show first and second connector housings 2, 4 in accordance with the invention which are disengageably secured to each other in side-by-side relationship. The first housing 2 is a wire holder which can be used as a connector housing and is described fully in application Ser. No. 081,195 filed Aug. 4, 1987, U.S. Pat. No. 4,797,112 which is hereby incorporated by reference in its entirety. Both housings are of a suitable thermoplastic material, such as a polyester having glass filling material sufficient to impart the required rigidity thereto. The housings can be molded as a single unit or can be molded separately and disengageably secured to each other by disengageable latching means as described below.

The first housing 2 has a wire-receiving surface or side 6, an obverse surface 8 which faces oppositely with respect to the wire-receiving surface, first and second side surfaces 10, 12 and oppositely facing end surfaces 14. A plurality of wire-receiving cavities 16 extend into the wire-receiving surface 2 and are arranged in side-by-side relationship in a row that extends between the ends 14. The cavities 16 have wire retainers 18 therein adjacent to each of the side surfaces so that when the end portion of a wire 60 is moved laterally of its axis into a cavity, it will be retained therein. When the wires 60 are assembled to the cavities, they are located such that the stripped ends of the wires will project beyond the side surface 12 and can serve as terminals when the housing 2 is installed on a circuit board. These stripped ends are protected by a wire protector 20 in the form of a bar which is spaced from, and extends parallel to, the surface 12. The bar 20 is removably integral with the housing 2 by means of spaced apart struts 22. Mounting means 24 are provided on the side surface 12 in the form of split projections having conical ends which can be collapsed when these projections are inserted into holes in the circuit board. When the housing 2 is mounted on the circuit board, it will be held thereon by the mounting projections 24 and the end portions of the wires will extend through circuit board holes which intersect terminal pads on the underside of the circuit board so that the wire ends can be soldered to the circuit board conductors.

The housing 2 differs slightly from the wire holder or housing shown in the above-identified U.S. Pat. No. 4,797,112 in that the width of the housing, as measured between the surfaces 6, 8, is greater than that of the housing or wire holder shown in the patent. This extra width provides improved stability when the housing is mounted on a circuit board and additionally is needed in order to provide openings 23 adjacent to the end walls 14 for the reception of latching members 58 which are provided on the housing 4. Additionally, openings are provided as shown at 25 to reduce the amount of plastic material and to facilitate solidification of the housing in the injection mold in accordance with good molding practice.

The second housing 4 has a wire-receiving surface 26, an obverse surface 28, first and second side surfaces 30, 32, and oppositely facing end surfaces 34. A pair of trough-like recesses 36 extend into the obverse surface 32 and are separated by a central barrier wall 38. These recesses are dimensioned to receive a complementary connector (not specifically shown) when the connector housing 4 is mounted in a panel or the like.

A plurality of wire and terminal receiving cavities 40 extend through the housing 4 from the wire-receiving surface to the recesses 36 and a contact terminal 42 is mounted in each of these cavities. Each terminal has a pin portion 44 which extends into one of the recesses 36, a retaining portion which retains it in the cavity, and a box-like wire connecting portion 46 which has wire-receiving slots 48. Hood-like walls 50 extend from the surface 26 and surround the entrances to the wire-receiving cavities, these hoods having barrier walls 52 between adjacent cavities on which are provided strain relief projections for retaining the wires after they have been inserted into the wire-receiving slots of the terminals.

Figure 3:
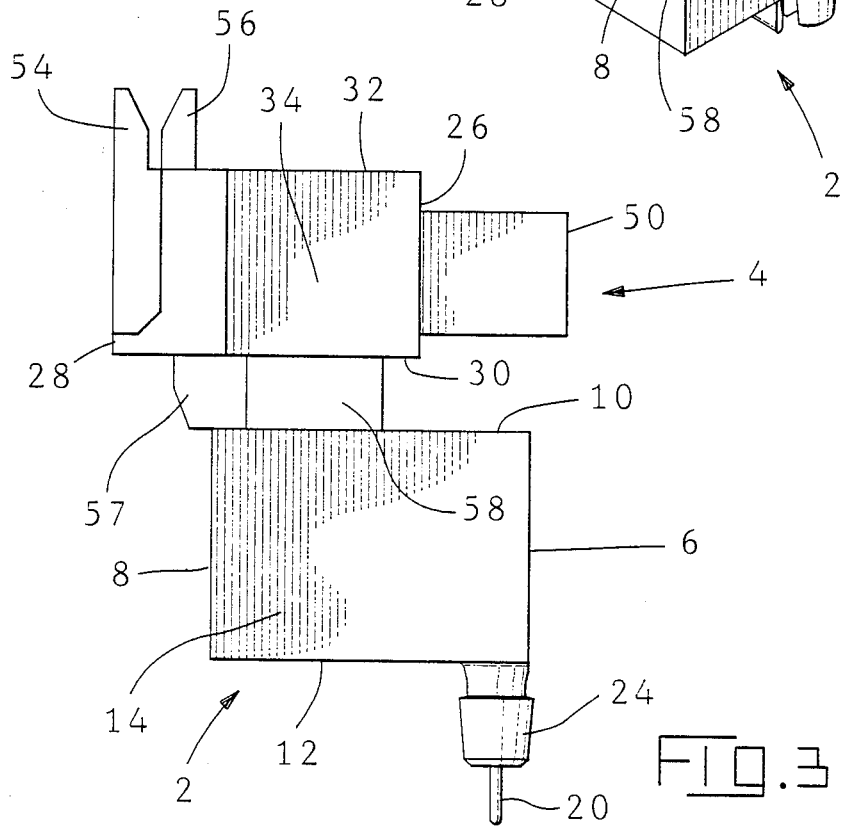
FIG. 3 is a side view of the housings.
Figure 4:
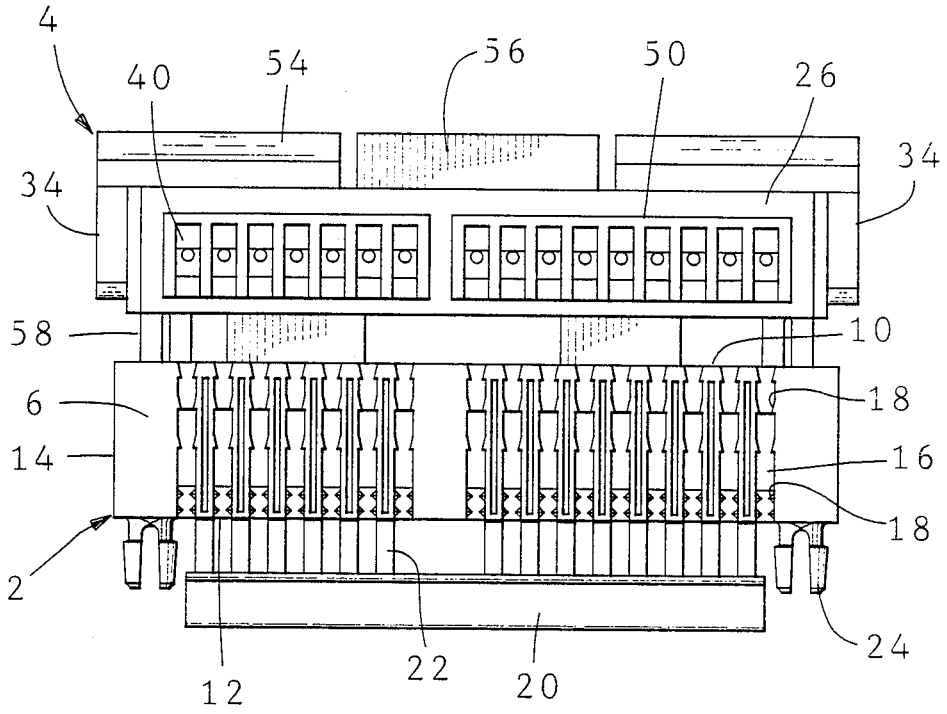
FIG. 4 is a plan view showing the wire-receiving surfaces of the housings.
Figure 5:
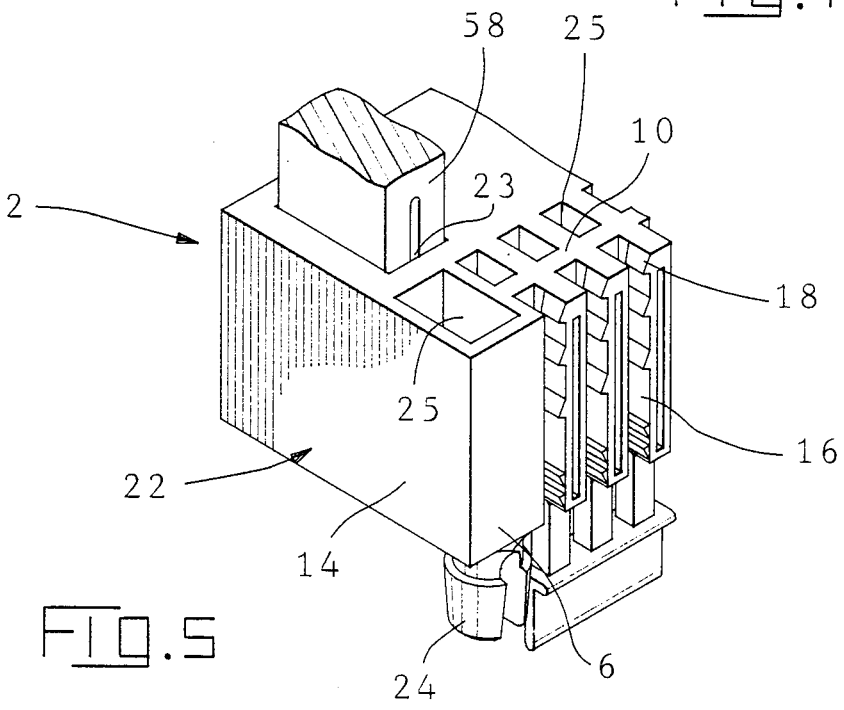
FIG. 5 is an enlarged fragmentary view showing an end portion of the first housing and showing the manner in which the two housings are disengageably secured to each other.
Figure 7:
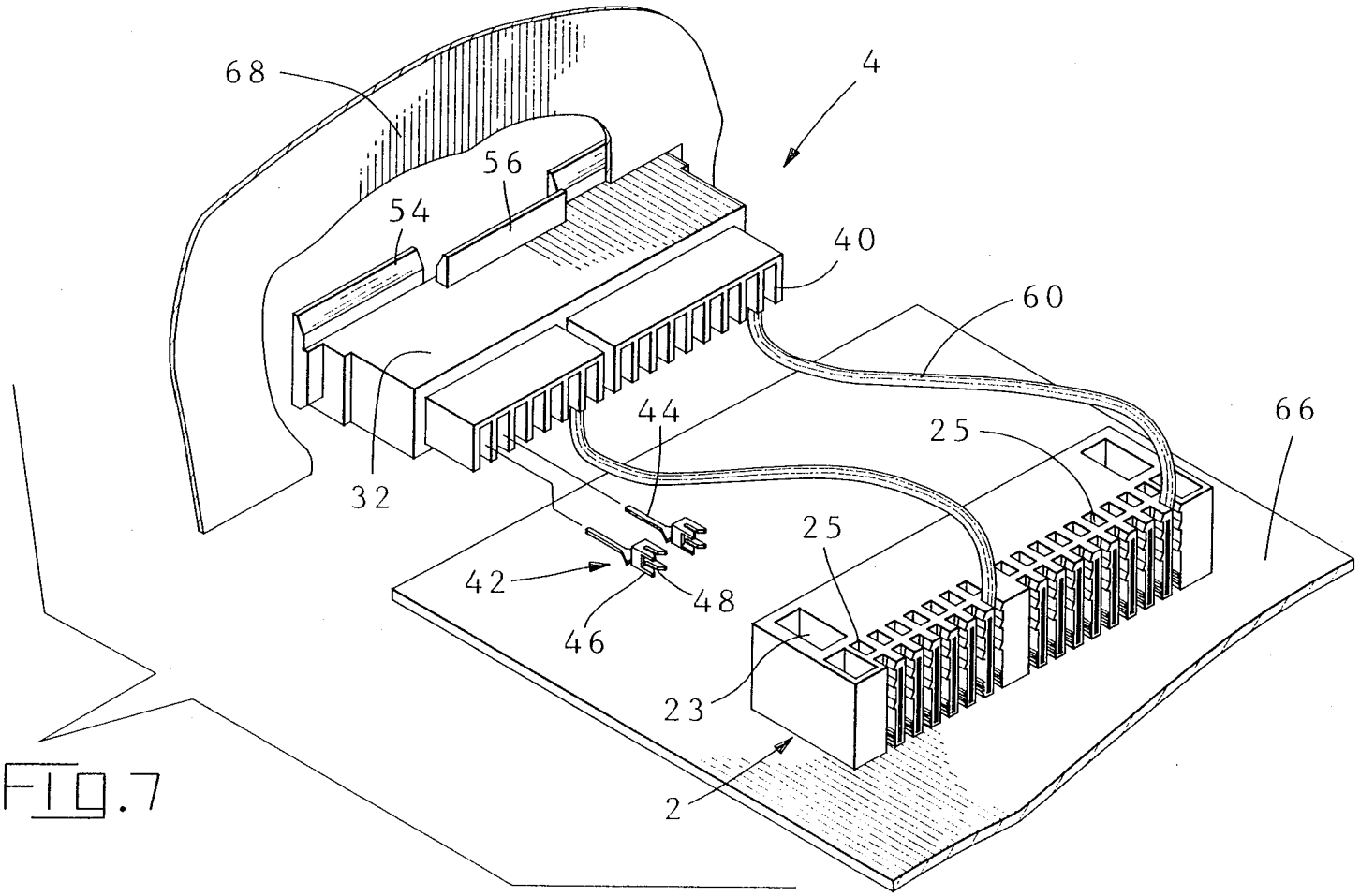
FIG. 7 is a view showing the harness installed in an apparatus.

The connector 4 is intended for mounting in an opening in a panel or the like 68 as shown in FIG. 7 and to this end has flanges 54, 56 extending from its surface 32 and has locating fins 57 on its surface 30 as shown in FIG. 3. Edge portions of the panel are received between the flanges 54, 56 and the edges of the fins 57 bear against the surface of the panel. Alternative mounting means can be provided, for example, mounting ears for fasteners as shown at 70 in FIG. 8.

The first and second housings 2, 4 are located in side-by-side spaced relationship with their first side surfaces 10, 30 opposed to each other. The embodiment of FIGS. 1–4 has securing means 58 for securing the housings to each other in the form of arms which are received in the openings 23 in the first housing. The arms have centrally located slots so that they are flexible and will be retained in the openings 23 as they are flexed together and the parts are assembled to each other. Alternatively, the two housings can be molded as a single unit connected by suitable removable struts similar to the struts 22 on the housing 2.

In the practice of the invention, the wires 60 are assembled to the two housings 2, 4 by aligning the end portions of the wires with the wire-receiving cavities in the housings. The ends which are received in the first housing 2 are stripped of their insulation so that the stripped ends 62 extend beyond the side wall 12 and are between adjacent struts 22. The other ends of the wires need not be stripped since they are moved laterally of their axes and into the wire-receiving cavities 40 and into the wire-receiving slots of the terminals. The operation of installing the connectors on the ends of the wires of the harness can be carried out with a suitable insertion machine properly modified for the closely spaced connector housings of the invention. After all of the wires have been inserted, the wires will form a loop extending from the first housing to the second housing.

Figure 6:
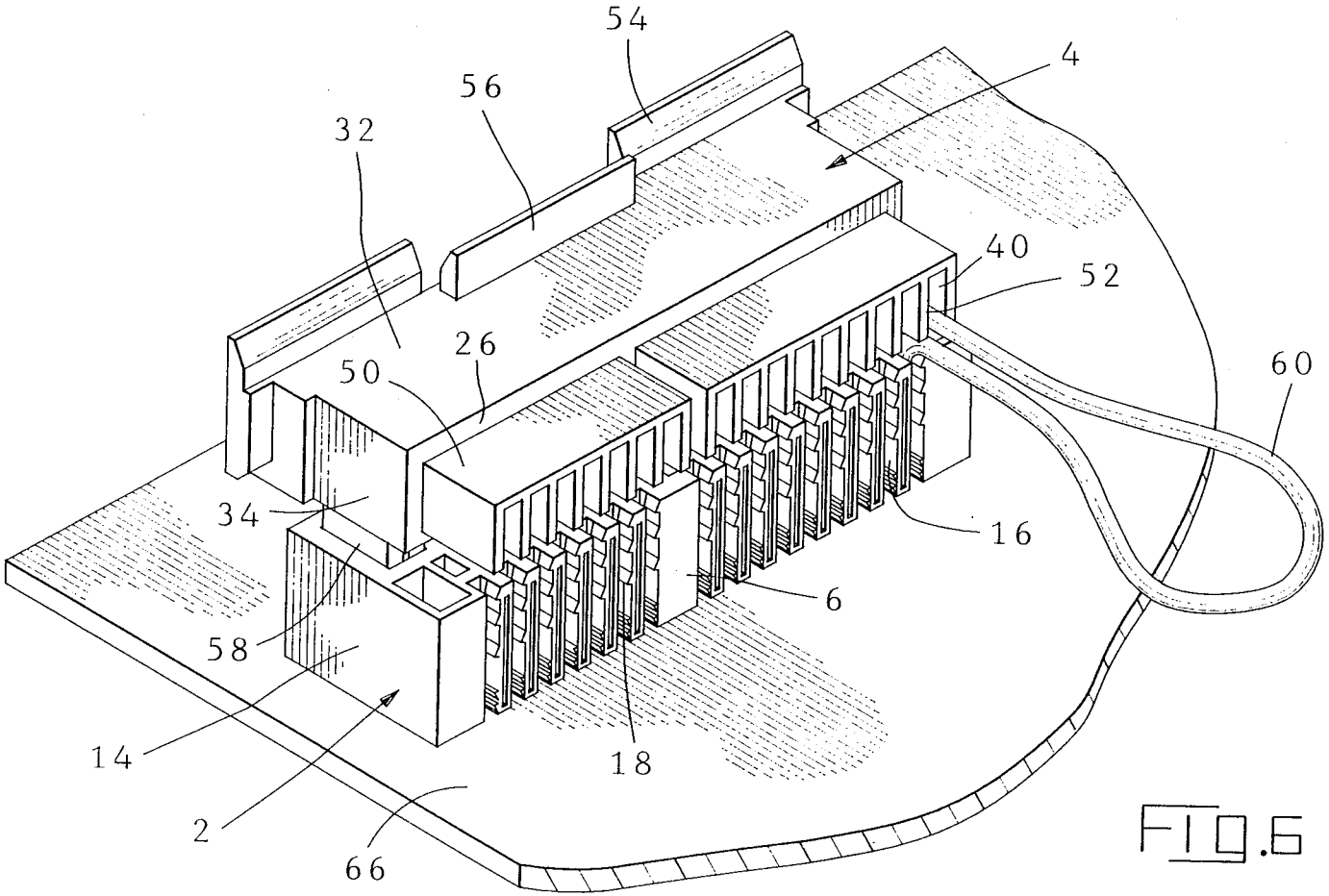
FIG. 6 is a view showing a harness in accordance with the invention with the first housing mounted on a circuit board and with the second housing disengageably secured to the first housing.

The two housings and the wires 60 constitute the completed harness which can then be assembled to the circuit board 66 as shown in FIGS. 6 and 7. The wire guard 20 is first removed and the first housing 2 is then mounted on the circuit board by means of the mounting projections 24 with the stripped ends 62 of the wires extending through circuit board holes which intersect conductors on the underside of the circuit board. The ends 62 of the wires, which are contact members, are then soldered to the circuit board conductors by means of a wave soldering machine. The circuit board is then installed in the apparatus for which it is intended, the second housing 4 is separated from the first housing, and the second housing is mounted in a panel or the like 68 of the apparatus.

Figure 8:
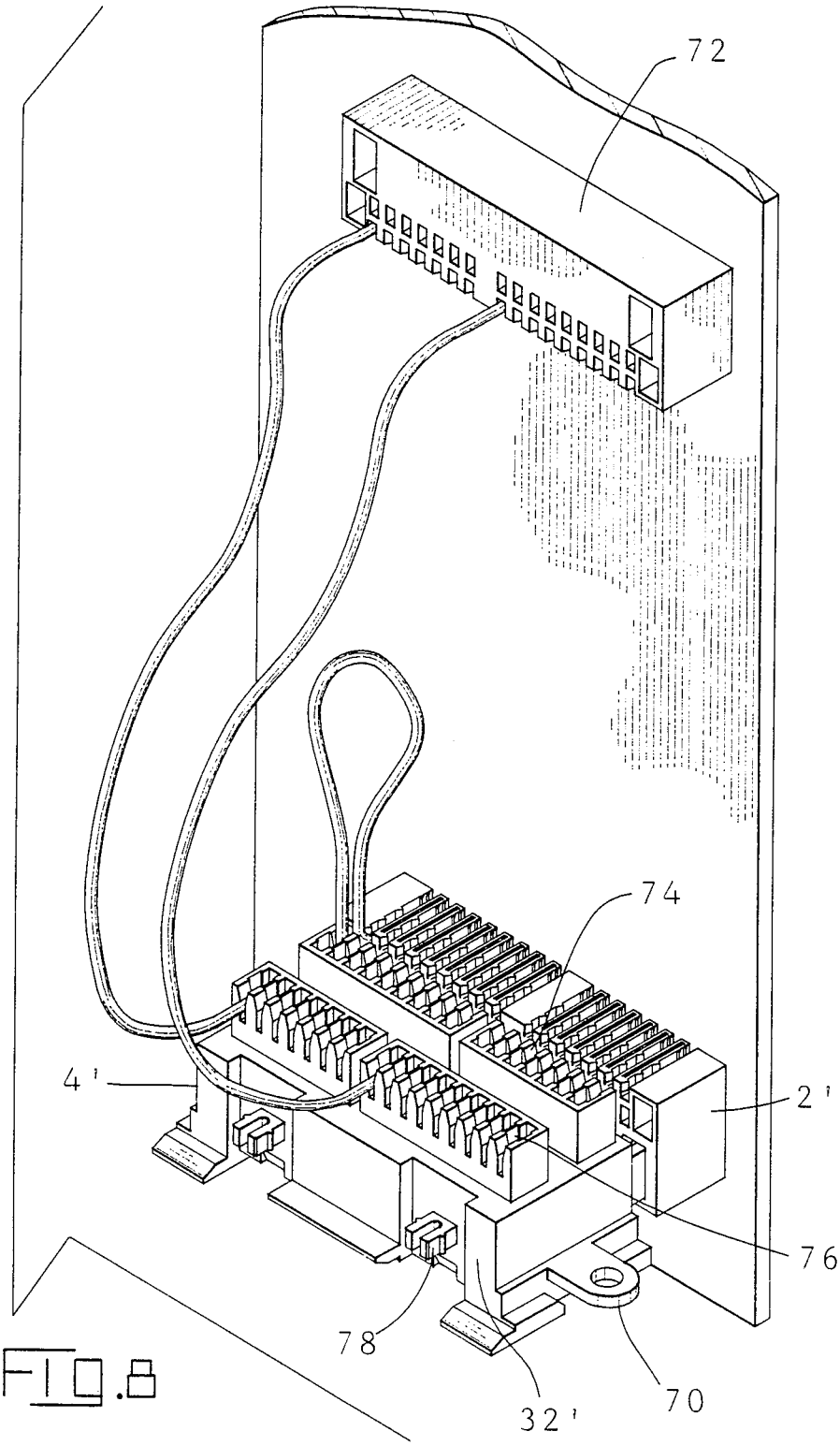
FIGS. 8 and 9 are views similar to FIGS. 6 and 7 but showing an alternative embodiment.
Figure 9:
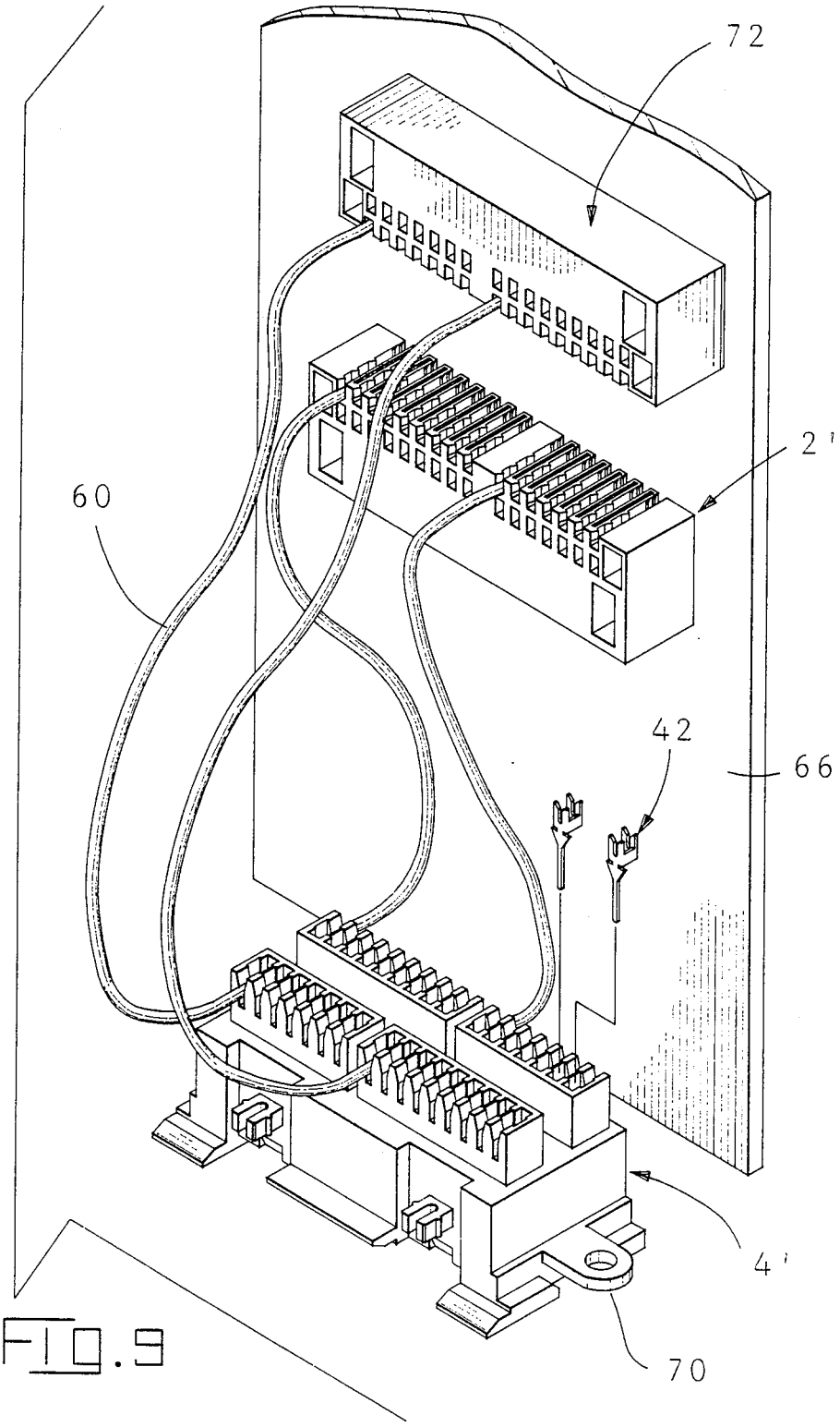

FIGS. 8 and 9 show an alternative embodiment in which a third housing 72 is required in order to make connections to circuit board conductors at two locations on the circuit board. The third housing 72 is removably secured adjacent to, and spaced from, the side surface 32' of the first housing 4'. In the practice of this embodiment, the housing 72 is disengaged from the housing 4' and mounted on the circuit board. The housing 2', with the housing 4' attached thereto, is then mounted on the circuit board as shown in FIG. 8. The terminals in housings 2' and 72 are then soldered to the circuit board conductors, the circuit board is installed in the apparatus for which it is destined, and the housing 4' is disengaged from the housing 2' and assembled to the apparatus. FIG. 8 shows an alternative method of securing the housings 2, 72 to the sides of the housing 4'. In this instance, the latching ears 78 are spaced substantially inwardly from the end surfaces of the housing 4'. Also, it will be noted that the housing 4' has two rows of wire-receiving cavities whereas the housing 4 has a single row.

It will be apparent that the principles of the invention can be used under circumstances where the circuit board connectors are of the surface mount type, that is where the circuit board connector is mounted on the circuit board on the same surface as the surface on which the conductors are provided. A wide variety of surface mount connectors are available which can be used in conjunction with a second connector as explained above. Under some circumstances also, the principles of the invention can be used where the flexible conductors are in the form of a ribbon cable or the like or are otherwise bonded to each other. Under such circumstances, the circuit board connector 2 would contain insulation penetrating terminals therein similar to the terminals contained in the housing 4.

It will be apparent from the foregoing description that the principles of the invention can result in substantial economies in the assembly of equipment in which contains circuit boards and which require electrical connections between conductors on the circuit board and further conductors. Economies in the assembly process are achieved by virtue of the fact that one connector is eliminated and the cost of the assembly is thereby reduced. In addition, the number of electrical interfaces is reduced and reliability is thereby improved.

I claim:

1. An electrical harness which is destined for installation in an apparatus which has a circuit board, the circuit board having circuit board conductors thereon, the harness comprising first and second electrical connector housings having first and second terminal means therein and flexible conductors which extend between the first and second terminal means, the first housing being destined for installation in the apparatus at a first location which is on the circuit board, the second housing being destined for installation in the apparatus at a second location which is not on the circuit board, the harness being characterized in that:

the first and second housings are adjacent to each other and are disengageably secured to each other, the flexible conductors forming a loop which extends from the first housing to the second housing, and the first terminal means have surface portions for soldering to circuit board conductors whereby, the first housing can be mounted on the circuit board and the first terminals means soldered to the circuit board conductors while the first and second housings are secured to each other, and thereafter the circuit board can be installed in the apparatus, the second housing can be disengaged from the first housing, and the second housing can be installed in the apparatus at the second location.

2. An electrical harness as set forth in claim 1 characterized in that the flexible conductors are discrete wires, each of the housings having a wire-receiving surface and having a plurality of wire-receiving cavities extending into its wire-receiving surface, the conductors having portions which are received in the wire-receiving cavities.

3. An electrical harness as set forth in claim 2 characterized in that the second terminal means have wire-receiving slots which are proximate to the wire-receiving surface of the second housing, the wires being received in the wire-receiving slots.

4. An electrical harness as set forth in claim 3 characterized in that the first housing is a wire holder which is usable as a connector, the first housing having a side surface which intersects the wire-receiving surface, the wire-receiving cavities in the first housing extending to, and intersecting, the side surface, the wires having end portions which extend beyond the side surface, the first terminal means being the end portions of the wires, the first housing having a removable guard integral therewith which extends parallel to, and which is spaced from the side surface, the first housing having mounting means on the side surface for mounting the harness on the circuit board during the soldering operation.

5. An electrical harness as set forth in claim 4 characterized in that the harness comprises a third connector housing which is substantially similar to the first connector housing, a plurality of selected wires extending from the second housing to the third housing, the third housing being disengageably secured to the second housing, the selected wires forming a second loop which extends from the second housing to the third housing.

6. An electrical harness as set forth in claim 1 characterized in that the flexible conductors are discrete wires, each of the first and second housings has a wire-receiving surface, an obverse surface which faces oppositely with respect to the wire-receiving surface, first and second side surfaces which extend from the wire-receiving surface to the obverse surface, and oppositely facing endwall surfaces, each of the housings having a plurality of side-by-side wire-receiving cavities extending into its wire-receiving surface, the cavities being in a row, each of the wire-receiving cavities having wire retaining means therein, the first and second housings being side-by-side with their first side surfaces mutually opposed to each other.

7. An electrical harness as set forth in claim 6 characterized in that the first housing is a wire holder which is usable as a connector, the wire-receiving cavities in the first housing extending to, and intersecting, the second side surface thereof, the wires having end portions which project beyond the second side surface of the first housing, the end portions constituting the first terminal means and being destined for insertion into holes in the circuit board and soldering to the circuit board conductors.

8. An electrical harness as set forth in claim 7 characterized in that the first housing has mounting means on the second side surface thereof for mounting the first housing on the circuit board.

9. An electrical harness as set forth in claim 1 characterized in that each of the first and second housings has a conductor-receiving surface, an obverse surface which faces oppositely with respect to the conductor-receiving surface, first and second side surfaces which extend from the conductor-receiving surface to the obverse surface, and oppositely facing endwall surfaces, each of the housings having a plurality of side-by-side conductor-receiving cavities extending into its conductor-receiving surface, the cavities being in a row, each of the conductor-receiving cavities having conductor retaining means therein, the first and second housings being side-by-side with their first side surfaces mutually opposed to each other.

10. First and second rectangular connector housings which are intended for installation on the ends of discrete wires in an electrical harness, each housing having a wire-receiving surface, an obverse surface which faces oppositely with respect to the wire-receiving surface, an each housing having first and second side surfaces which extend from the wire-receiving surface to the obverse surface, the housings being characterized in that:

each of the housings has a plurality of wire-receiving cavities extending into its wire-receiving surface, the cavities in each housing being in side-by-side relationship in a row, the cavities in the first housing extending at least partially across the wire-receiving surface and extending normally of the side surfaces, each of the cavities having wire retaining means therein for retaining a wire upon movement of the wire laterally of its axis and into the cavity, the first and second housings being side-by-side and adjacent to each other with the wire-receiving surfaces facing in a common direction and with their first side surfaces mutually opposed to each other, the housings being disengageably secured to each other, whereby, the electrical harness can be manufactured by inserting the ends of the wires into the wire-receiving cavities in the first and second housings, and the housings can be disengaged from each other when the harness is assembled to the apparatus in which it is destined to be installed.

11. First and second connector housings as set forth in claim 10 characterized in that the first housing is a wire holder which is usable as a connector, the wire-receiving cavities in the first housing extending to, and intersecting, the second side surface of the first housing.

12. First and second connector housings as set forth in claim 11 characterized in that the first housing has a wire guard for protecting the end portions of wires which are contained in the cavities, the guard comprising a bar-like member which extends beside, and is spaced from, the second side surface of the first housing, there being clearance space between the second side surface and the bar-like member, the bar-like member being removable from the first housing whereby, the end portions of wires which are contained in the cavities of the first housing will project into the clearance space, and after removal of the bar-like member from the first housing, the end portions can be connected to further conductors such as circuit board conductors while the second housing is secured to the first housing, the first housing being destined for mounting on a circuit board and having mounting means on the second side surface thereof for mounting on the circuit board.

13. First and second connector housings as set forth in claim 12 characterized in that the second housing has a mating side and has contact terminals in the wire-receiving cavities thereof, the terminals extending into the housing towards the mating side.

14. First and second connector housings as set forth in claim 13 characterized in that the mating side is the obverse side.

15. First and second connector housings as set forth in claim 14 characterized in that the first and second housings are secured to each other by interengaged means.

16. First and second connector housings as set forth in claim 10 characterized in that a third connector housing is provided which is disengageably secured to at least one of the first and second housings, the third housing having a wire-receiving surface and having a plurality of wire-receiving cavities extending into its wire-receiving surface, the third housing being destined for installation on wires extending from at least one of the first and second housings.

17. A method of manufacturing an electrical harness and installing the harness on an apparatus, the harness being of the type comprising first and second multi-contact electrical connectors having first and second terminal means therein, the first and second terminal means being connected to each other by flexible conductors, the apparatus comprising at least one circuit board, the first connector being destined for installation in the apparatus at a first location on the circuit board with the first terminal means soldered to circuit board conductors on the circuit board, the second connector being destined for installation in the apparatus at a second location which is not on the circuit board, the method comprising the steps of:

providing the first and second connectors as a unit with the connectors disengageably joined to each other, assembling the flexible conductors to the first and second connectors so that intermediate portions of the flexible conductors extend between the connectors, installing the first connector on the circuit board and soldering the first terminal means to the circuit board conductors, installing the circuit board in the apparatus, disengaging the first and second connectors from each other, and installing the second connector in the apparatus.

18. A method as set forth in claim 17 characterized in that the flexible conductors are discrete wires having first and second ends which are in the first and second connectors respectively, the second terminal means comprising terminals having wire-receiving slots, and the step of assembling the wires to the second connector is carried out by inserting the second ends into the wire-receiving slots.

19. A method as set forth in claim 18 characterized in that the first terminal means comprises the first ends of the wires, and the step of assembling the conductors to the first connector is carried out by placing the first ends in the first connector.

20. A method as set forth in claim 19 characterized in that the circuit board has the circuit board conductors on one surface thereof, the first location being on the other surface of the circuit board, the circuit board having holes extending therethrough at the first location, and the step of installing the first connector on the circuit board is carried out by inserting the first ends through the holes and soldering the first ends to the circuit board conductors.

* * * * *